US007926660B2

(12) United States Patent
Jones et al.

(10) Patent No.: US 7,926,660 B2
(45) Date of Patent: Apr. 19, 2011

(54) CHILD RESISTANT BLISTER PACKAGE HOUSING WITH TOOLED ACCESS

(75) Inventors: Steve Jones, Elon, NC (US); Rodney Dixon, Burlington, NC (US); Catherine Becker, New York, NY (US); William Rigby, Spring Hope, NC (US); Caleb Loftin, Raleigh, NC (US)

(73) Assignee: MeadWestvaco Corporation, Richmond, VA (US)

( * ) Notice: Subject to any disclaimer, the term of this patent is extended or adjusted under 35 U.S.C. 154(b) by 138 days.

(21) Appl. No.: 12/259,025

(22) Filed: Oct. 27, 2008

(65) Prior Publication Data

US 2010/0102062 A1 Apr. 29, 2010

(51) Int. Cl.
*B65D 83/04* (2006.01)

(52) U.S. Cl. ..... 206/531; 206/532; 206/469

(58) Field of Classification Search ..... 206/528, 206/531, 534, 538, 539, 469, 532; 220/269
See application file for complete search history.

(56) References Cited

U.S. PATENT DOCUMENTS 4,330,079 A 5/1982 Wood
4,411,370 A * 10/1983 Rausing ..... 220/269
4,925,034 A * 5/1990 Robichaud et al. ..... 229/204
5,944,191 A * 8/1999 Ray et al. ..... 206/532
6,659,280 B2 * 12/2003 Paliotta et al. ..... 206/531
6,675,972 B2 * 1/2004 Patterson ..... 206/531
6,951,282 B2 * 10/2005 Jones ..... 206/469
7,726,485 B2 * 6/2010 Brollier ..... 206/534
2004/0188312 A1 * 9/2004 Stepowany ..... 206/531
2007/0084747 A1 * 4/2007 Gherdan et al. ..... 206/531
2007/0221534 A1 * 9/2007 Intini ..... 206/532
2009/0188832 A1 * 7/2009 Pham ..... 206/531
2009/0242451 A1 * 10/2009 Kessler ..... 206/531

* cited by examiner

*Primary Examiner* — David T Fidei

(74) *Attorney, Agent, or Firm* — MWV Intellectual Property Group

(57) ABSTRACT

A packaging blank includes a first panel and a second panel. The first panel defines at least one blister aperture and at least one tool portion. The second panel defines at least one tab strip and at least one tool access portion. The at least one tab strip is at least partially severable from the packaging blank. The at least one tool access portion is substantially completely severable from the packaging blank. The first panel and the second panel are configured to be positioned relative to one another in a face contacting arrangement such that a first portion of a given tool portion is to be operably aligned with a corresponding tool access portion. As such, the first portion of the given tool portion thereby is capable of being accessed by a tool via the corresponding tool access portion.

17 Claims, 14 Drawing Sheets

CHILD RESISTANT BLISTER PACKAGE HOUSING WITH TOOLED ACCESS

TECHNICAL FIELD

The present invention relates generally to child resistant blister packaging for the packaging and dispensing of articles. More specifically, the present invention is directed to a package including a child resistant blister package housing for encapsulating one or more blister packages and allowing controlled and child-resistant packaging and dispensing of articles

BACKGROUND

It is known that blister packaging can be used to store and deliver a wide range of items. Among the many types of items that can be stored and delivered in blister packs are pharmaceutical products, such as tablets, pills, capsules, and other related items. Conventional blister packages include a blister tray that is typically a thermoformed plastic sheet with a plurality of blister cells or depressions formed therein. Typically, after items are placed in the cells, the items are retained and protected in the respective cells by securing a backing sheet to the blister tray. The backing sheet is often a thin layer of metal foil, plastic, paperboard, or other material secured to the back of the blister tray, thereby sealing the cells. In other types of blister packages, the contents are placed in substantially puncture-proof foil containers that can be covered with foil or paperboard backing.

In many blister packages, the foil backing is thin enough to be punctured mechanically, or ruptured by pressing the blister so that the encapsulated item penetrates the foil backing. If the backing sheet is made from, for example, paperboard, or similar material, then the backing often includes gates in the backing sheet that covers the openings of respective blister cells. In practice, each gate is deformed or manipulated so that it ruptures or partially separates from the surrounding paperboard to allow the item contained within the blister cell to be pushed out of the blister cell for use.

While the conventional blister packaging is viewed by many to be suitable for most applications, there are several design deficiencies. The conventional packages provide removal of the items from the blister cells, but offer little in the way of resisting child tampering. Child resistance is a feature that is desired, particularly for dose pharmaceutical packaging.

To address the desirability of child resistance, many blister packaging designs employ materials of increased rigidity, compared to conventional non-child-resistant packages. For example, in increased-rigidity packages, the backing sheet and/or the blister cells can be made thicker and/or more resistant to pressure. As such, a young child is unlikely to be able to generate the pressure required to force the package contents through the increased-strength materials. In addition to the benefits in terms of child-resistance, increased rigidity can provide additional protection for the enclosed materials, which may be, as is the case with pharmaceuticals, fragile and susceptible to breakage.

DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. As used herein, the terms "foldable score line" and "severance line" refer to all manner of lines indicating optimal fold or cut locations, frangible or otherwise weakened lines, perforations, a line of perforations, a line of short slits, a line of half-cuts, a single half-cut, a cut line, scored lines, slits, any combination thereof, and the like.

The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

It is contemplated that the present invention is not limited to the pharmaceutical and personal healthcare related articles referenced with the illustrated embodiment. Instead, embodiments of packaging made in accordance with the present invention can have application in packaging for any small, delicate, sensitive, or portable article. Furthermore, the packaging can be used for larger items as a method of decreasing the incidence of product theft. Examples of articles for which such packaging can be employed include all manner of consumable products such as candy, food, vitamins, tobacco, and the like; all manner of personal care products such as contact lens, birth control devices, smoking cessation patches, hearing aid batteries, and the like; as well as any item that can fit within a portable container.

Figure 1:
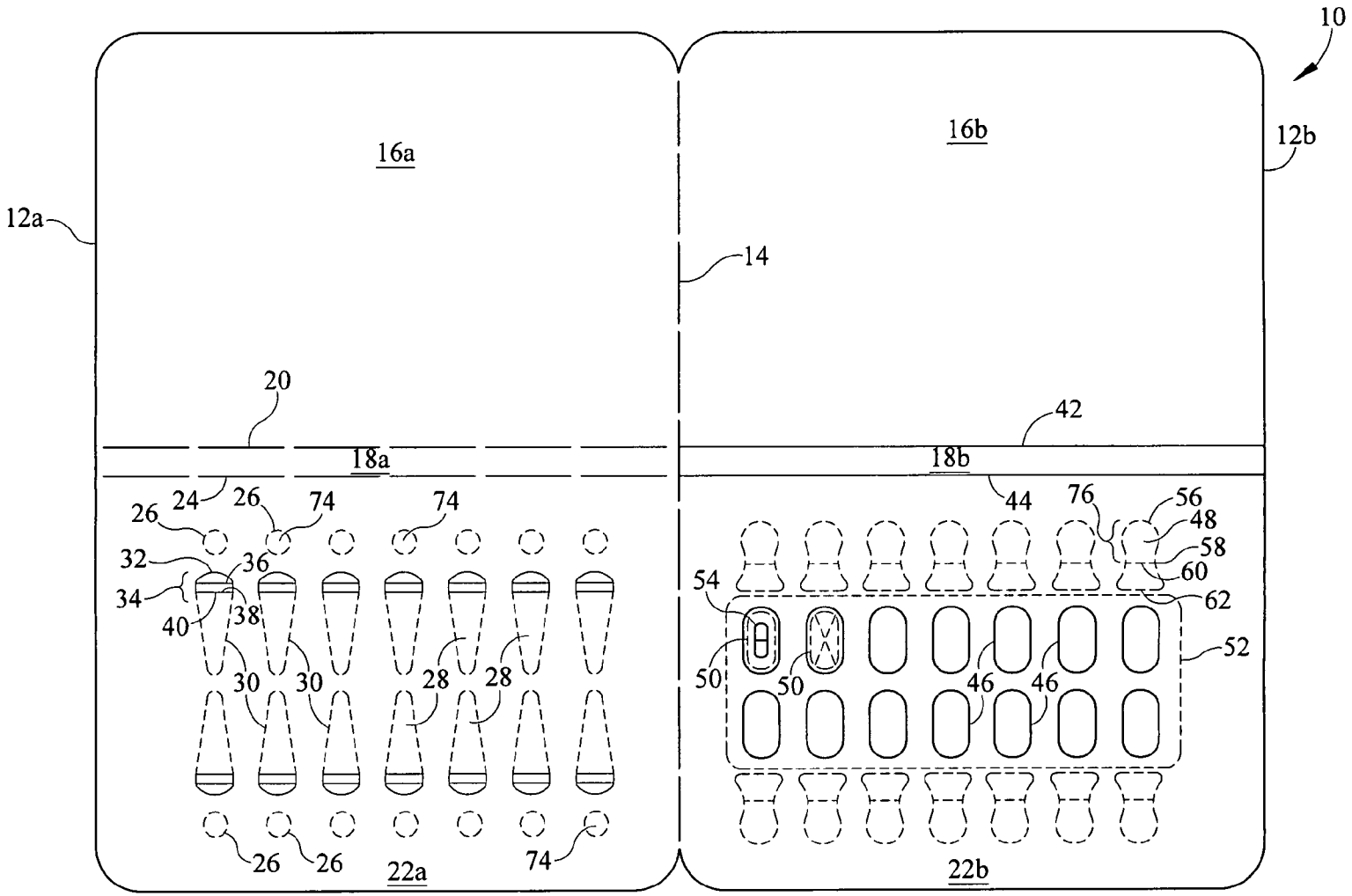
FIG. 1 is a plan view of an exemplary packaging blank, according to an embodiment of the present invention.

Referring now to the drawings, wherein like elements are represented by like numerals, and wherein like articles and respective elements are, at times, represented by primed numerals, FIG. 1 is a plan view of an exemplary packaging blank 10 made according to the present invention.

The packaging blank 10 includes a back panel 12*a* and a face panel 12*b*. The face panel 12*b* and the back panel 12*a* are hingedly connected along a foldable score line 14. Although in this exemplary embodiment, the panels 12*a*, 12*b* are illustrated as integrally formed as one piece, it should be understood that the respective panels 12*a*, 12*b* can be formed as two separate and distinct pieces.

The packaging blank 10 can be constructed from any suitable substrate material. Suitable substrate materials include, but not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from MeadWestvaco Corporation. Additionally, it is contemplated that embodiments of the present invention may be used in conjunction with NATRALOCK® packaging systems. Additionally, a tear-resistant layer may or may not be adhered to the packaging blank 10. Tear-resistant layers, if included, are often laminated to the blank before cutting. Furthermore, it is possible, and in fact contemplated, that an adhesive layer or material may be added to the packaging blank 10 prior to assembling the packaging blank 10 into a package, as will be explained below. The packaging blank 10 may also be an unbleached board, depending on the desired appearance of the final package.

The back panel 12*a* further includes a top portion 16*a*. The top portion 16*a* is hingedly connected to a spacer portion 18*a* along a foldable score line 20. The spacer portion 18*a* is hingedly connected to a bottom portion 22*a* along a foldable score line 24. The bottom portion 22*a* further includes severance lines 26 and tab strips 28. The severance lines 26 can be shaped and dimensioned to allow removal of material by interfacing with and/or receiving a tool in a method that will be described in more detail below. A tab strip 28 can be defined by a severance line 30 and a cut line 32, and can further include a pull tab portion 34. A pull tab portion 34 can include foldable score lines 36, 38 and a cut line 40. As will be explained in greater detail below, the tab strips 28 can have any desired shape and dimensions. For example, the bottom panel 22*a* can be configured to include gates (not shown) that can be left after a tab strip 28 is removed.

The face panel 12*b* further includes a top portion 16*b*. The top portion 16*a* is hingedly connect to a spacer portion 18*b* along a score line 42. The spacer portion 18*b* is hingedly connected to a bottom portion 22*b* along a score line 44. Bottom portion 22*b* further includes blister apertures 46 and tool portions 48. The blister apertures 46 are shaped and dimensioned to receive the blisters 50 of a blister pack 52. As illustrated, one or more blisters 50 can contain a product 54, illustrated in FIG. 1 as a capsule of medication. In the illustrated embodiment, the tool portions 48 are formed by a severance lines 56 in the bottom portion 22*b*. A tool portion can further include a cut line 58 and foldable score line 60. A least a portion of a tool portion 48 can be hingedly connected to the bottom panel 22*b* along a foldable score line 62.

Figure 2:
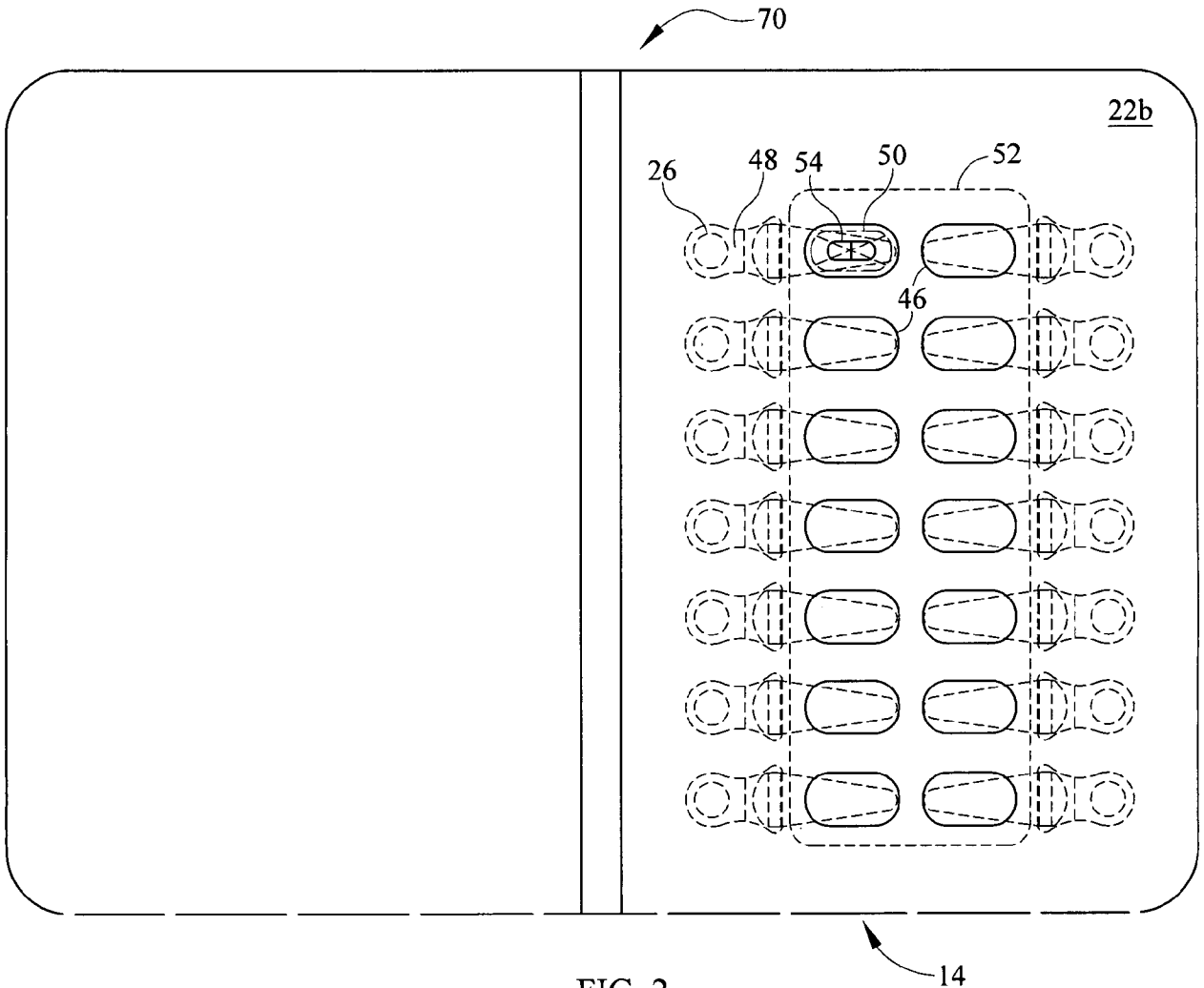
FIG. 2 is a plan view of an exemplary package, made from the packaging blank of FIG. 1.
Figure 3:
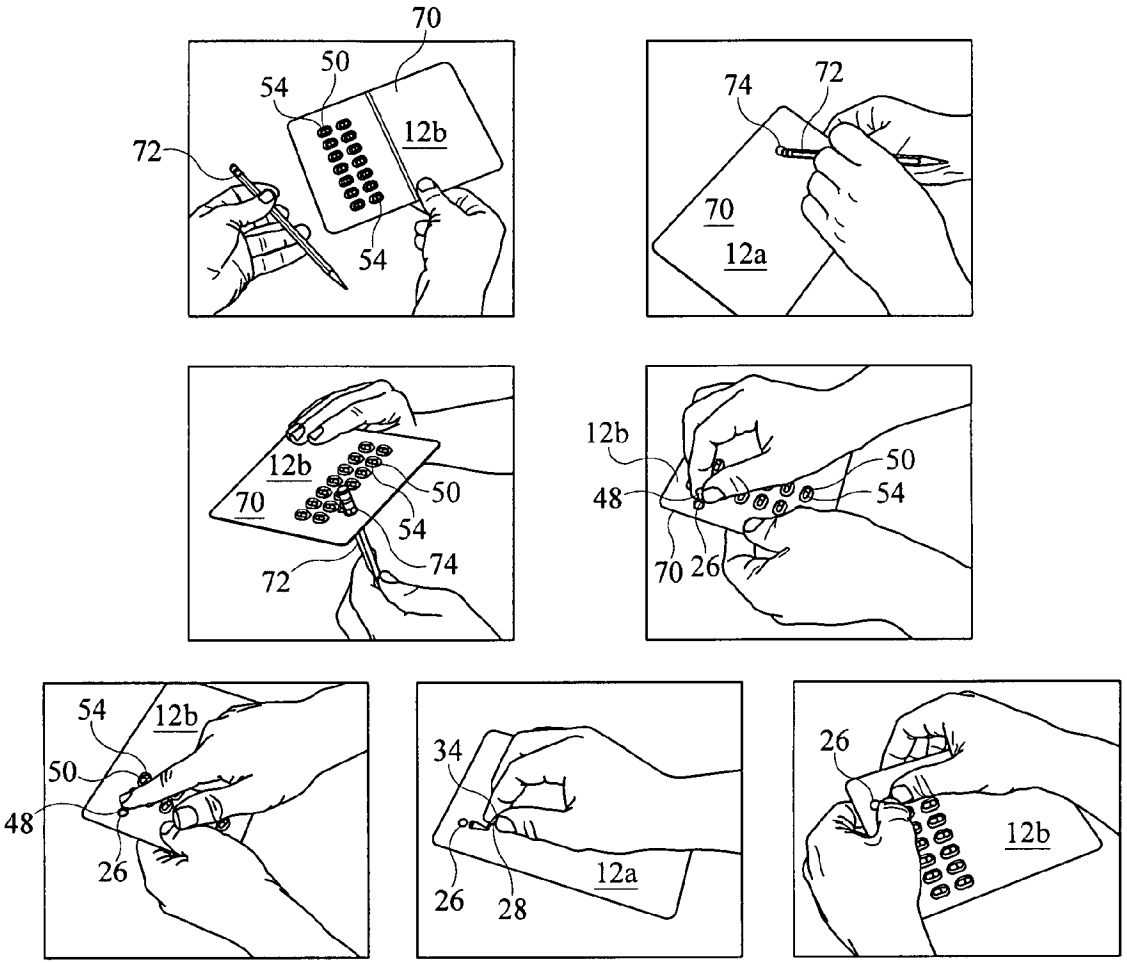
FIG. 3 illustrates a method for accessing products packaged in the exemplary package of FIG. 2.

With additional reference now to FIGS. 2-3, a package 70, made from packaging blank 10, is shown. A package 70 is formed by inserting the blisters 50 of a blister pack 52 into respective blister apertures 46, such that the blisters 50 protrude from the face panel 12*b*. After the blister pack 52 is in position, the blank 10 can be folded into a face contacting arrangement, and secured. To fold the blank 10, the facing surfaces of the bottom panel 12*a* and the face panel 12*b* are brought toward each other by folding along foldable score line 14. In completing the folding step, the tab strips 28 are aligned with respective blister apertures 46, and thereby with blisters 50 of blister pack 52. Likewise, the severance lines 26 cooperatively align with respective tool portions 48. The face panel 12*b* and the bottom panel 12*a* can be secured to one another, and the blister pack 52 can thereby be held in place, using any desired means or methods.

In practice, to access an item 54 from a package 70, a tool 72, illustrated as a pencil, is pressed onto a tool access portion 74, which is defined by score line 26 in bottom panel 12*a*. When pressure is applied to a tool access portion 74, the circular piece of material defined by score line 26 is severed from the bottom panel 12*a* and is then pushed into, and applies force to, an interface portion 76 of a tool portion 48. When force is applied to the interface portion 76, at least a portion of the tool portion 48 is severed from the face panel 12*b* along severance line 56. Since a portion of a tool portion 48 is now severed, a user can grasp the severed portion of the tool portion 48 and lift it away from the face panel 12*b*, thereby separating most of the tool portion from the face panel 12*b*.

As shown in FIGS. 1-3, part of a tool portion 48 is hingedly connected to face panel 12*b* by a foldable score line 62. As such, tool portion 48 remains attached to face panel 12*b* after severance line 56 has been severed.

After the tool portion 48 is accessible, the tool portion is folded along foldable score line 60, by folding the interface portion 76 toward the beginning of a tab strip 28 on bottom panel 12*a*, which is visible in the area revealed by lifting a tool portion 48 away from face panel 12*b*. The interface portion 76 of tool portion 48 can now be pushed into a pull tab portion 34 of a tab strip 28. When force is applied to the pull tab portion 34, the pull tab portion 34 separates from the bottom panel 12*a* along severance line 30. The pull tab portion 34 can be made more accessible to a user's grasp by the inclusion of foldable score lines 36, 38, and cut line 40. This can encourage the pull tab portion 34 to bend up and away from the applied force, thereby encouraging pull tab portion 34 to lift away from the package 70. At this point, a user can grasp the pull tab portion 34 and pull the pull tab portion 34 away from face panel 12*b*, thereby severing tab strip 28 from bottom panel 12*a*. As mentioned above, the shape of severance line 30 can be altered as desired to create gates (not shown) to add more child-resistance to the package 70. Alternative tab strip 28 designs will be discussed in further detail below.

Figure 4:
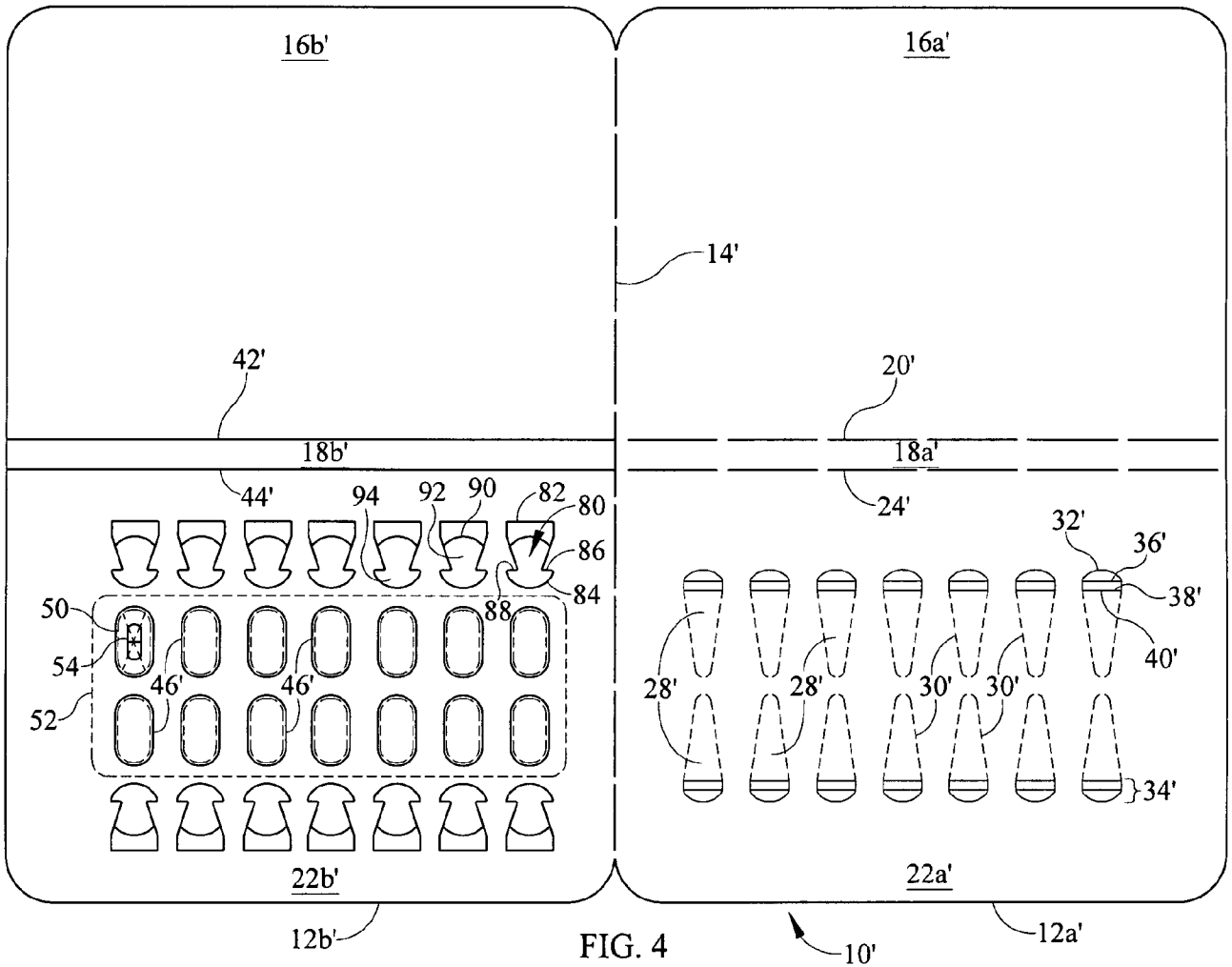
FIG. 4 is a plan view of an exemplary packaging blank, according to an embodiment of the present invention.

Referring now to FIG. 4, an alternative design for a packaging blank 10' is shown. In FIG. 4, primed numerals denote features that can have similar structure, design, and/or purpose as the features denoted by unprimed numerals in FIGS. 1-3.

The packaging blank 10' includes a bottom panel 12*a*', and a face panel 12*b*'. The panels 12*a*', 12*b*' are hingedly connected along foldable score line 14'. Although in this exemplary embodiment, the panels 12*a*', 12*b*' are illustrated as integrally formed as one piece, it should be understood that the respective panels 12*a*', 12*b*' can be formed as two separate and distinct pieces.

The bottom panel 12*a*' can further include a top portion 16*a*', which is hingedly connected to a spacer portion 18*a*', along a foldable score line 20'. The spacer portion 18*a*' is hingedly connected to a bottom portion 22*a*' along a foldable score line 24'.

The bottom portion 22*a*' further includes tab strips 28'. A tab strip 28' can be defined by a severance line 30' and a cut line 32' and can include a pull tab portion 34'. A pull tab portion 34' can includes foldable score lines 36', 38' and a cut line 40'. As will be explained in greater detail below, the tab strips 28' can have any desired shape and dimensions. For example, the bottom panel 22*a*' can be configured to include gates (not shown) that can be left after a tab strip 28' is removed.

The face panel 12*b*' can include a top portion 16*b*'. The top portion 16*b*' is hingedly connected to a spacer portion 18*b*' along a foldable score line 42'. The spacer portion 18*b*' is hingedly connected to a bottom portion 22*b*' along a foldable score line 44'. Bottom portion 22*b*' further includes blister apertures 46' and tool portions 80. The blister apertures 46' are shaped and dimensioned to receive the blisters 50 of a blister pack 52. As illustrated, one or more blisters 50 can contain a product 54, illustrated in FIG. 4 as a capsule of medication. In the illustrated embodiment, the tool portions 80 are formed by cut lines 82, 84, and fold lines 86, 88 in the bottom portion 22*b*'. The fold lines 86, 88 can hingedly connect the tool portions 80 to the bottom panel 22*b*' and create a fulcrum or pivot point about which the tool portions 80 can rotate. An additional cut line can be made in a tool portion 80, and the material between cut lines 82 and 90 can be removed to create a graspable edge 90 of a tool portion 80.

It should be understood that while the tool portions 80 of the illustrated embodiment are formed from two cut lines 82, 84, some or all of cut lines 82, 84 can be substituted for a severance line; thereby increasing the child-resistant qualities of a package made from the packaging blank 10'.

Figure 5:
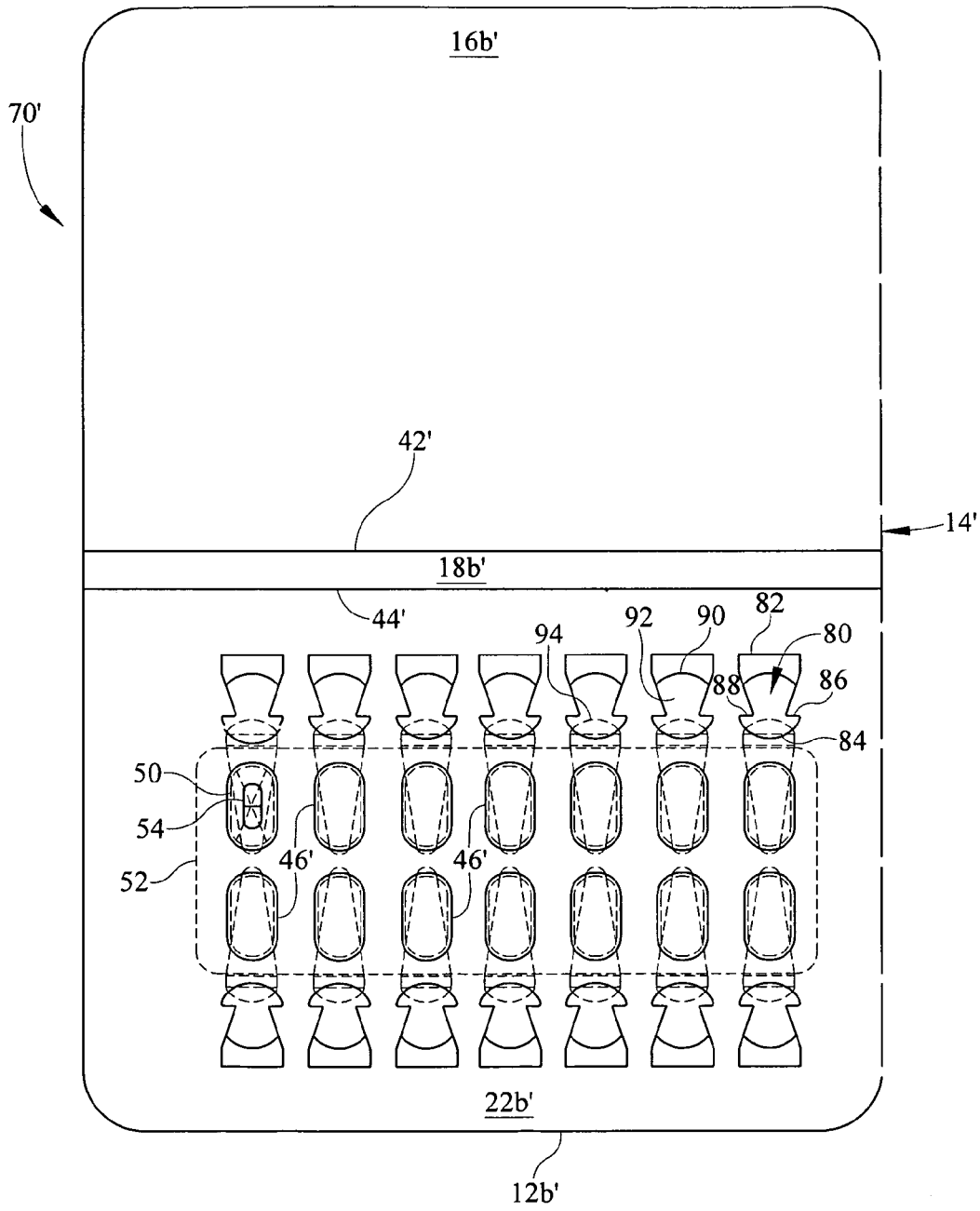
FIG. 5 is a plan view of an exemplary package, made from the packaging blank of FIG. 4.
Figure 6:
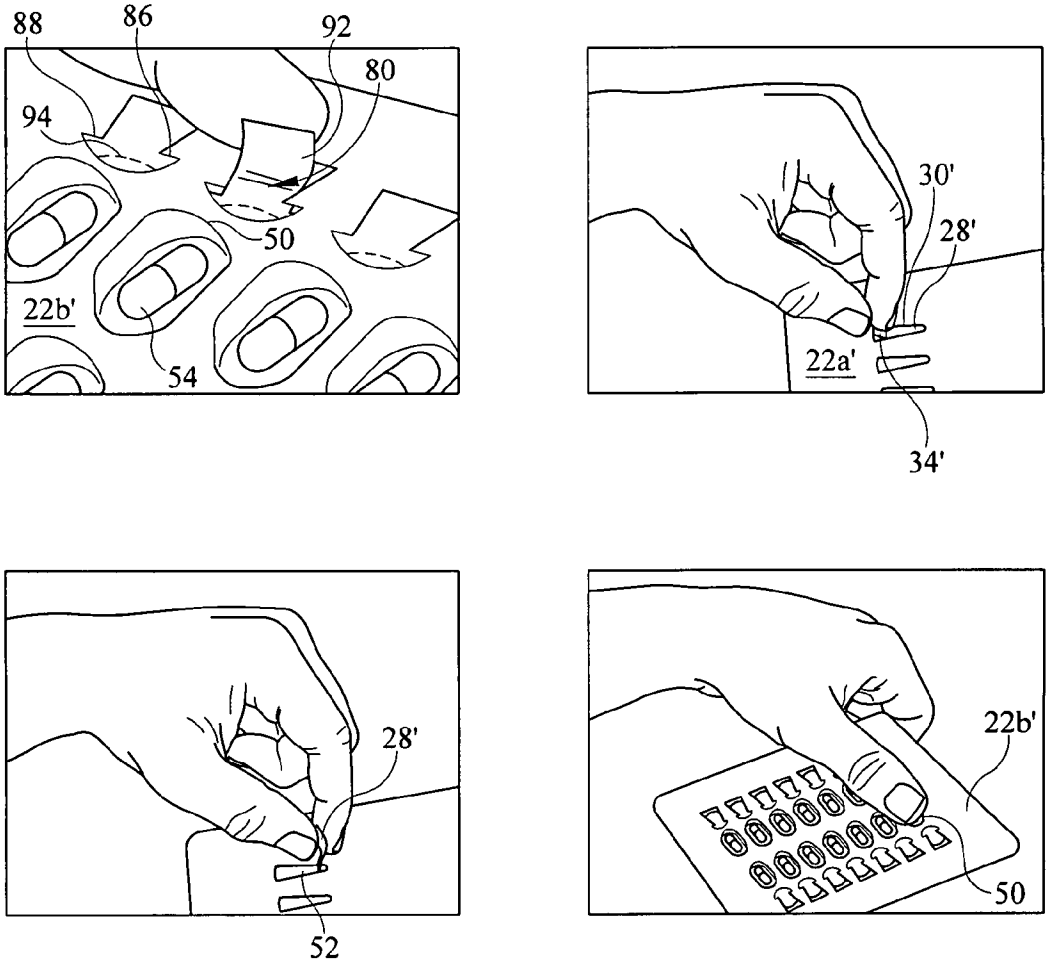
FIG. 6 illustrates a method for accessing products packaged in the exemplary package of FIG. 5.

With additional reference now to FIGS. 5-6, a package 70', made from packaging blank 10', is shown. A package 70' is formed by inserting the blisters 50 of a blister pack 52 into respective blister apertures 46', such that the blisters 50 protrude from the face panel 12*b*'. After the blister pack 52 is in position, the blank 10' can be folded into a face contacting arrangement, and secured. To fold the blank 10', the facing surfaces of the bottom panel 12*a*' and the face panel 12*b*' are brought toward each other by folding along foldable score line 14'. In completing the folding step, the tab strips 28' are aligned with respective blister apertures 46', and thereby with blisters 50 of blister pack 52. The face panel 12*b*' and the bottom panel 12*a*' can be secured to one another, and the blister pack 52 can thereby be held in place, using any desired means or methods.

In practice, to access an item 54 from a package 70', upward pressure, i.e., a pressure that pulls away from the face panel 12*b*' and the bottom panel 12*a*', is applied to a pull-away portion 92 of a tool portion 80. When such a force is applied to the pull-away portion 92, the tool portion 80 rotates along fold lines 86, 88 and an actuator portion 94 of the tool portion 80 thereby rotates downward, i.e., into a pull tab portion 34' of a tab strip 28'. This force, applied by an actuator portion 94 to a pull tab portion 34', causes the pull tab portion 34' to at least partially separate from the bottom panel 12*a*' along cut line 32' and severance line 30'. The pull tab portion 34' can be made more accessible to a user's grasp by the inclusion of foldable score lines 36', 38', and cut line 40'. This causes the pull tab portion 34' to bend up and away from the applied force, thereby encouraging pull tab portion 34' to lift away from the package 70'. At this point, a user can grasp the pull tab portion 34' and pull away from face panel 12*b*', thereby severing at least a portion of tab strip 28' from bottom panel 12*a*'. As mentioned above, the shape of severance line 30' can be altered as desired to create gates (not shown) to add more child-resistance to the package 70'. Alternative tab strip 28' designs will be discussed in further detail below.

Figure 7:
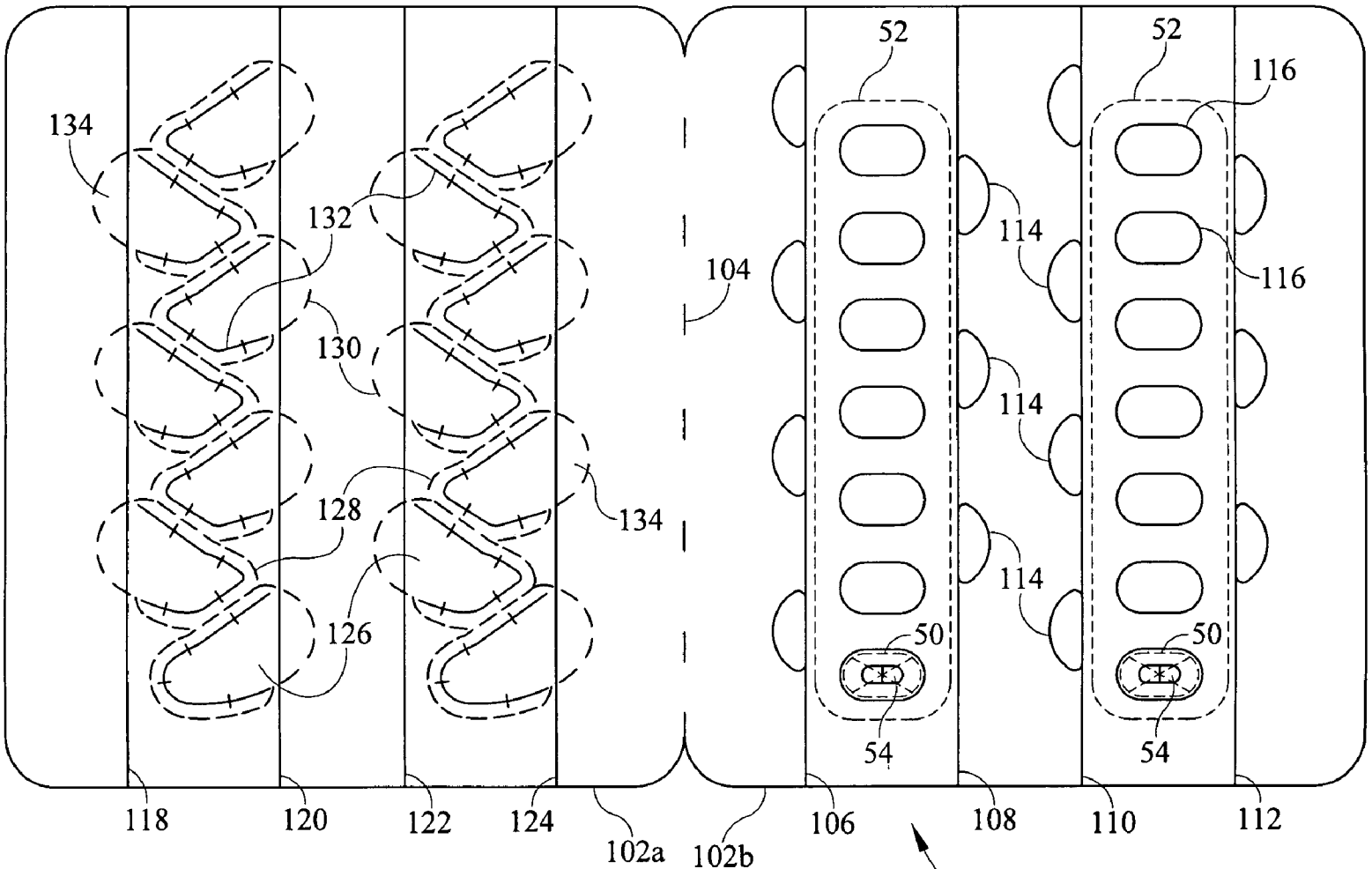
FIG. 7 is a plan view of an exemplary packaging blank, according to an embodiment of the present invention.

Referring now to FIG. 7, an alternative design for a packaging blank 100 is shown. The packaging blank 100 includes a bottom panel 102*a*, and a face panel 102*b*. The panels 102*a*, 102*b* are hingedly connected along foldable score line 104. Although in this exemplary embodiment, the panels 102*a*, 102*b* are illustrated as integrally formed as one piece, it should be understood that the respective panels 102*a*, 102*b* can be formed as two separate and distinct pieces.

The face panel 102*b* can include foldable score lines 106, 108, 110, and 112. The face panel 102*b* can also include tool access apertures 114. The tool access apertures 114 can be shaped and dimensioned to receive a tool, a user's hand, or another suitable device therethrough. Additionally, the face panel 102*b* can include blister apertures 116. The blister apertures 116 are shaped and dimensioned to receive the blisters 50 of a blister pack 52. As illustrated, one or more blisters 50 can contain a product 54, illustrated in FIG. 7 as a capsule of medication.

The bottom panel 102*a* can include foldable score lines 118, 120, 122, and 124. The bottom panel 102*a* further includes tab strips 126. The tab strips 126 can be defined by severance lines 128 and 130, and cut lines 132. The tab strips 126 can include a pull tab portion 134 that is defined by severance lines 126 and foldable score lines 118, 120, 122, and 124. In the illustrated embodiment, the severance lines 126 that define the pull tab portions 134 pass through both sides of the bottom panel 102*a*. However, severance lines 128 and 130, as well as cut lines 132, only pass through a portion of the bottom panel 102*a*.

As will be explained in greater detail below, the tab strips 126 can have any desired shape and dimensions. For example, the bottom panel 102*a* can be configured to include gates (not shown) that can be left after a tab strip 126 is removed.

Figure 8:
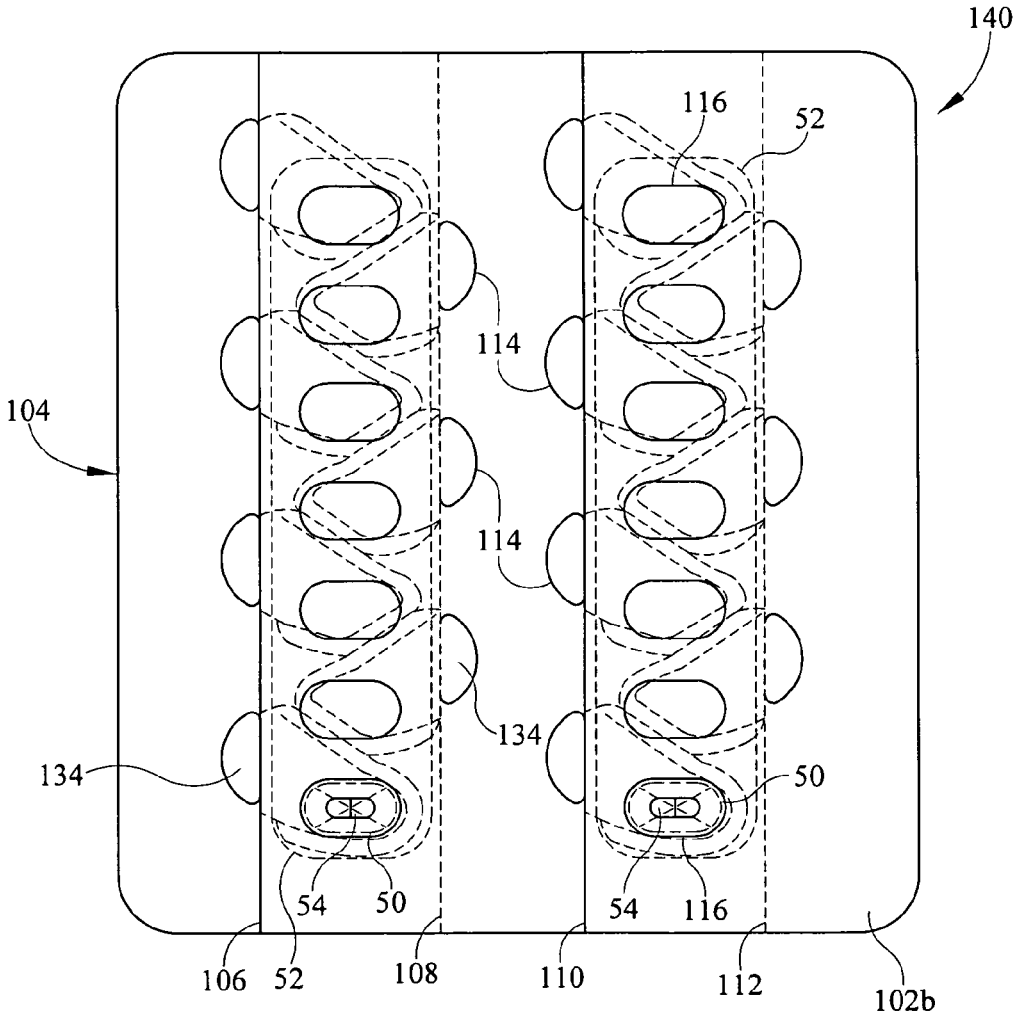
FIG. 8 is a plan view of an exemplary package, made from the packaging blank of FIG. 7.
Figure 9:
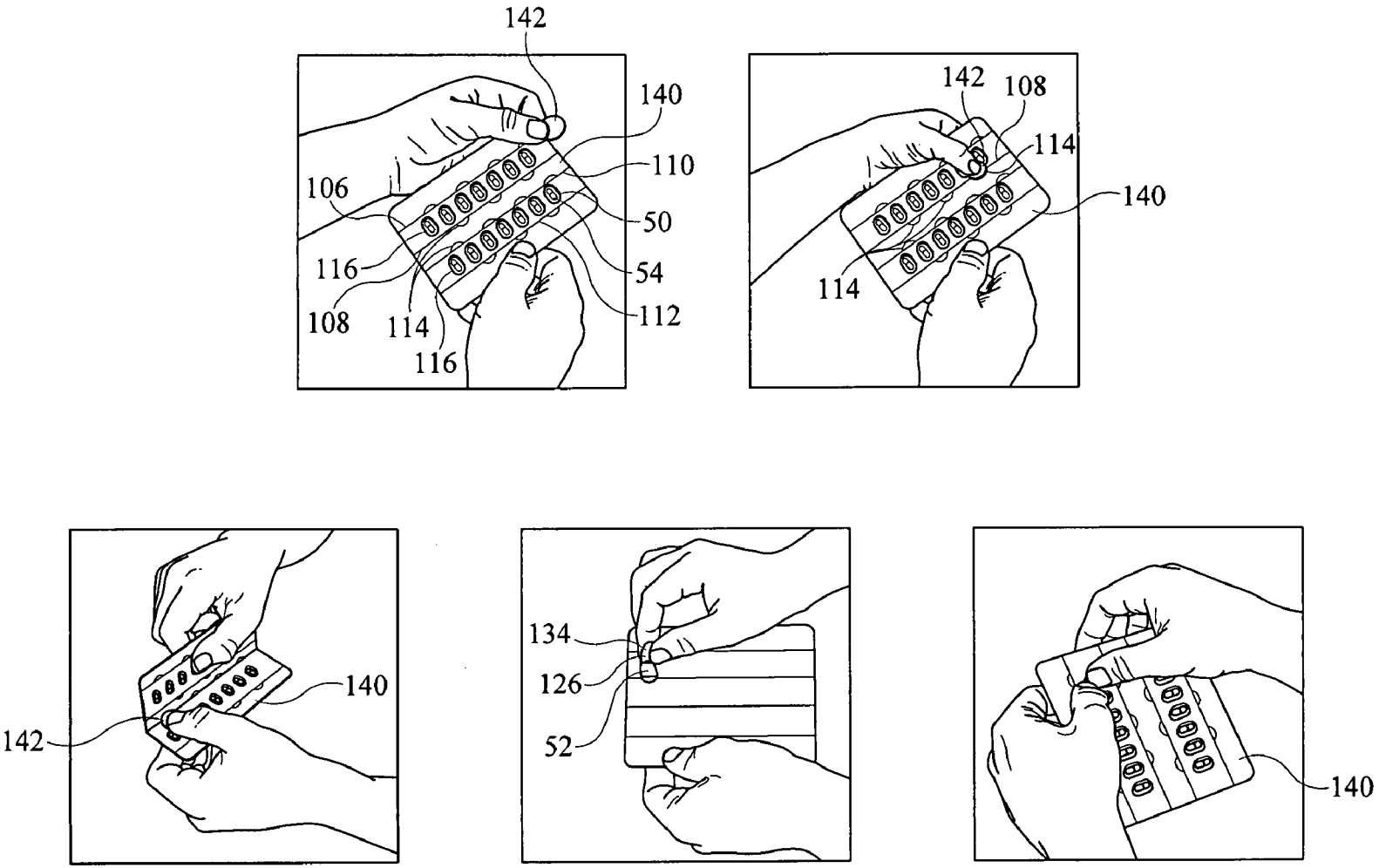
FIG. 9 illustrates a method for accessing products packaged in the exemplary package of FIG. 8.

With additional reference now to FIGS. 8-9, a package 140, made from packaging blank 100, is shown. A package 140 is formed by inserting the blisters 50 of one or more blister packs 52 into respective blister apertures 116, such that the blisters 50 protrude from the face panel 102*b*. In the illustrated embodiment, the package 140 contains two single-row blister packs 52. It should be understood that the package 140 can include less than two blister pack 52 or more than two blister packs, and although the illustrated blister packs 52 appear identical, there can be any number of blister packs 52, each with a different shape, dimensions, and/or contents. After the blister packs 52 are in position, the blank 100 can be folded into a face contacting arrangement, and secured. To fold the blank 100, the facing surfaces of the bottom panel 102*a* and the face panel 102*b*, are brought toward each other by folding along foldable score line 104. In completing the folding step, the tab strips 126 are aligned with respective blister apertures 116, and thereby with blisters 50 of blister pack 52. The face panel 102*b* and the bottom panel 102*a* can be secured to one another, and the blister pack(s) 52 can thereby be held in place, using any desired means or methods.

In practice, to access an item 54 from a package 140, a user places a tool 142 into a tool access aperture 114. In the illustrated embodiment, the tool access apertures 114 are shaped and dimensioned to accept at least a portion of a standard current-issue U.S. penny.

In the illustrated embodiment, the tool 142, in this case a penny is laid down with a leading edge of the penny placed such that an edge of the penny aligns with an edge of a tool access aperture 114. After placing the tool 142 in place, the entire package 140 is bent along one of the four available foldable score lines 106, 108, 110, and 112, namely, the fold line adjacent the tool access aperture 114 with which the tool 142 is aligned. It should be noted that after assembly of the package 140 from packaging blank 100, foldable score lines 106, 108, 110, and 112 are aligned with, and cooperate with, foldable score lines 118, 120, 122, and 124. As the package 140 is being bent, the tool 142 can be held in place. The package 140 can be bent until the force of the tool pushing on a pull tab portion 134 of a tab strip 126 causes the pull tab portion 134 to become severed from the surrounding material of the bottom panel 102*a*. Once the pull tab portion 134 is severed from the surrounding material of the bottom panel 102*a*, the user can grasp the pull tab portion 134 and pull the tab strip 126 away from the blister pack 52 until the tab strip 126 is either severed from the package 140, or until there is adequate access to allow an item 54 to pass out of the package 140.

Figure 10:
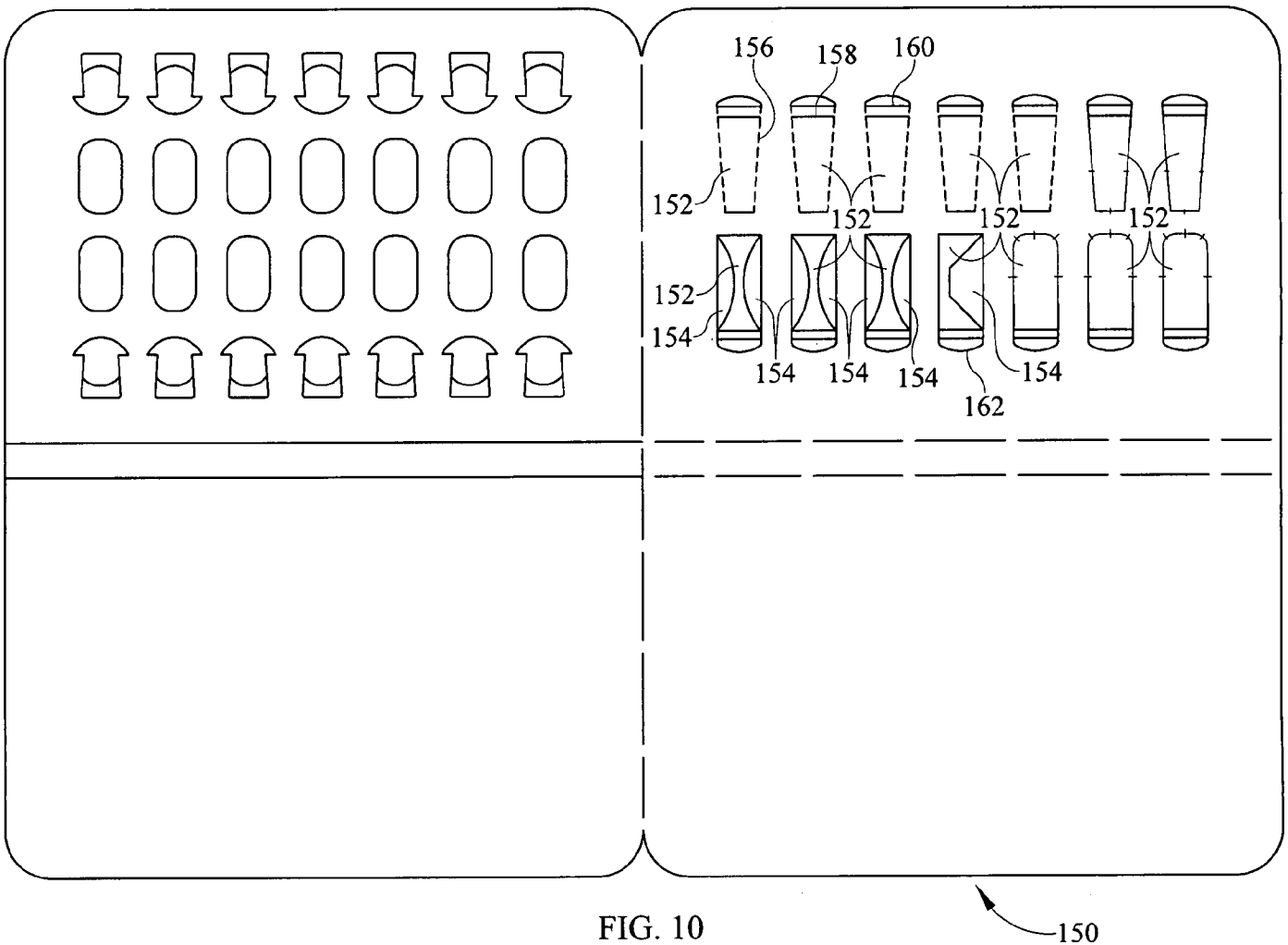
FIG. 10-11 illustrate various shapes for tab strips of packaging made in accordance with the present invention.

Turning now to FIGS. 10-15, alternative designs for various features of packaging are illustrated. FIG. 10 illustrates a package blank 150. Although the illustrated package blank 150 appears somewhat similar to the package blank 10' of FIG. 4, the concepts described herein can be employed with any of the described embodiments, or any embodiment of this invention made in accordance with the concepts of the foregoing description.

As illustrated, a package blank 150 includes a plurality of tab strips 152. Although the tab strips 152 are illustrated as having varied designs, shapes, and dimensions, some or all of the tab strips 152 can be substantially identical. Some of the illustrated tab strips have an irregular shape to provide gates 154 upon removal of the tab strips 152. The tab strips 152 can be formed by severance lines 156, cut lines 158, 160, fold lines 162, and combinations thereof. While many of the lines of FIG. 10 are represented as either cut lines, severance lines, or fold lines, it should be understood that the tab strips 152 can be formed from any desired combination of line types, as desired or required for any particular purpose or application. For example, the inclusion of gates 154 and the varying of line types employed to form the tab strips 152 can change the relative level of child resistance of a package 150.

Figure 11:
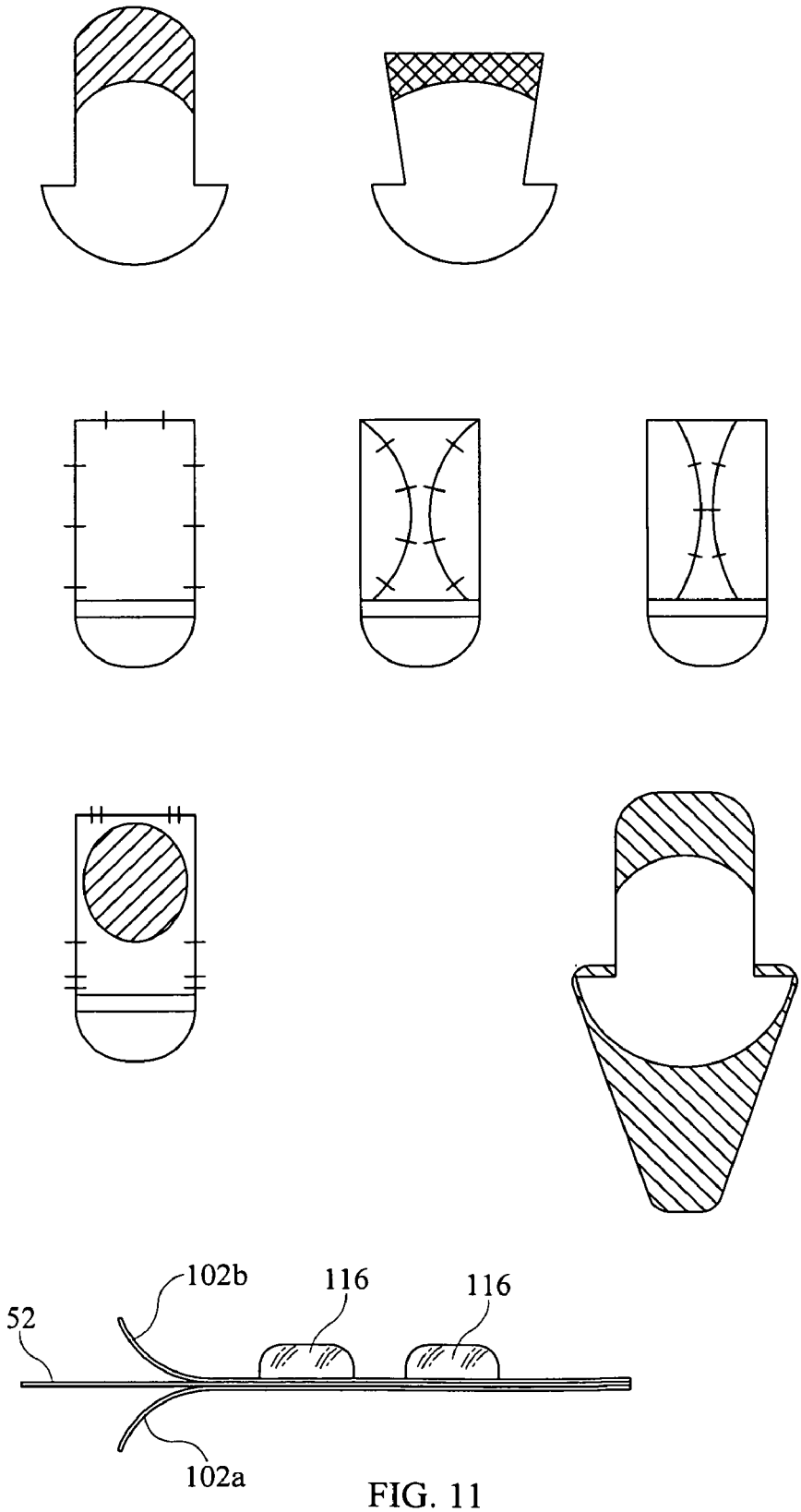
Figure 12:
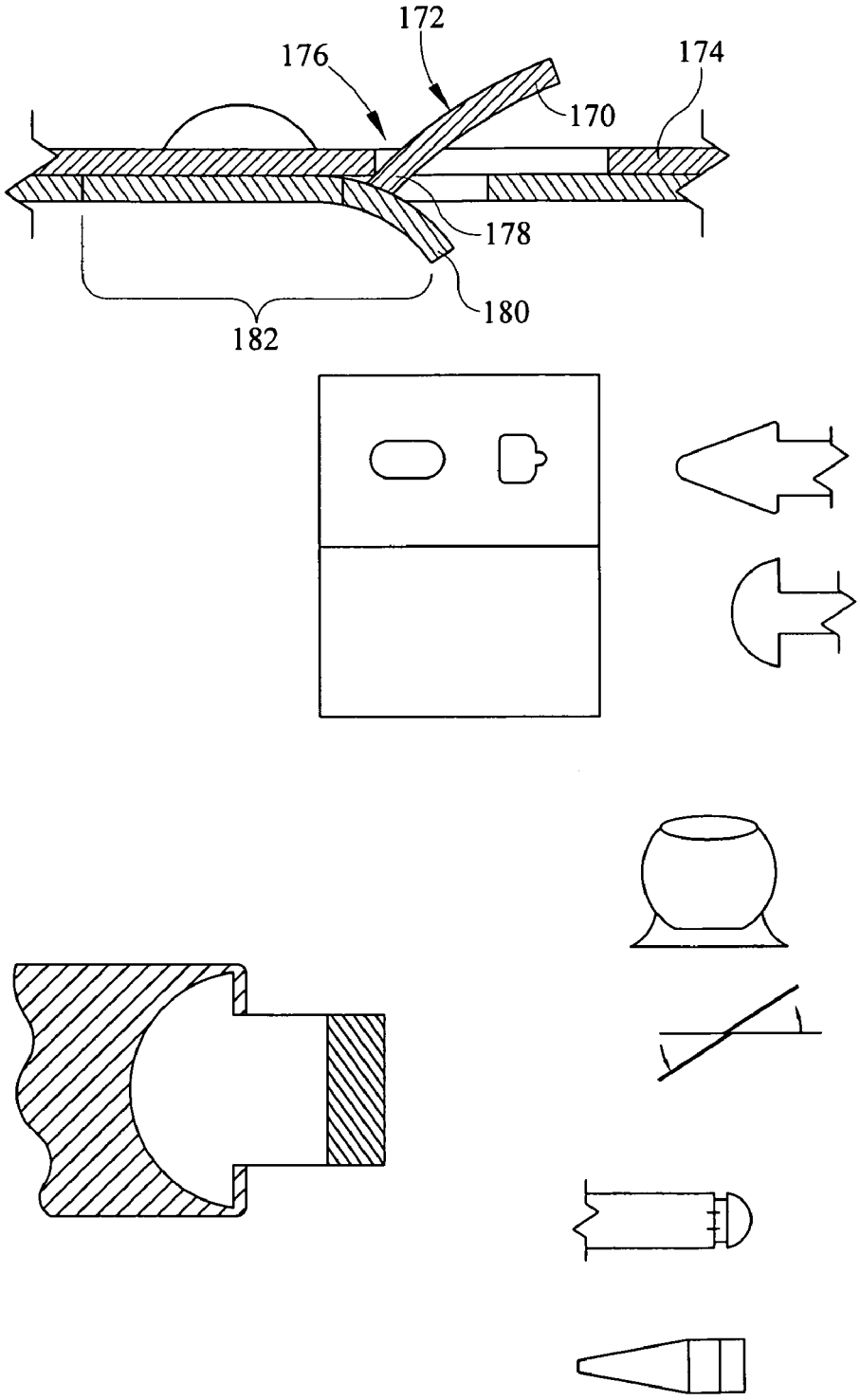
FIG. 12-14 illustrate the pivoting action of tool portions of packaging made in accordance with the present invention.
Figure 13:
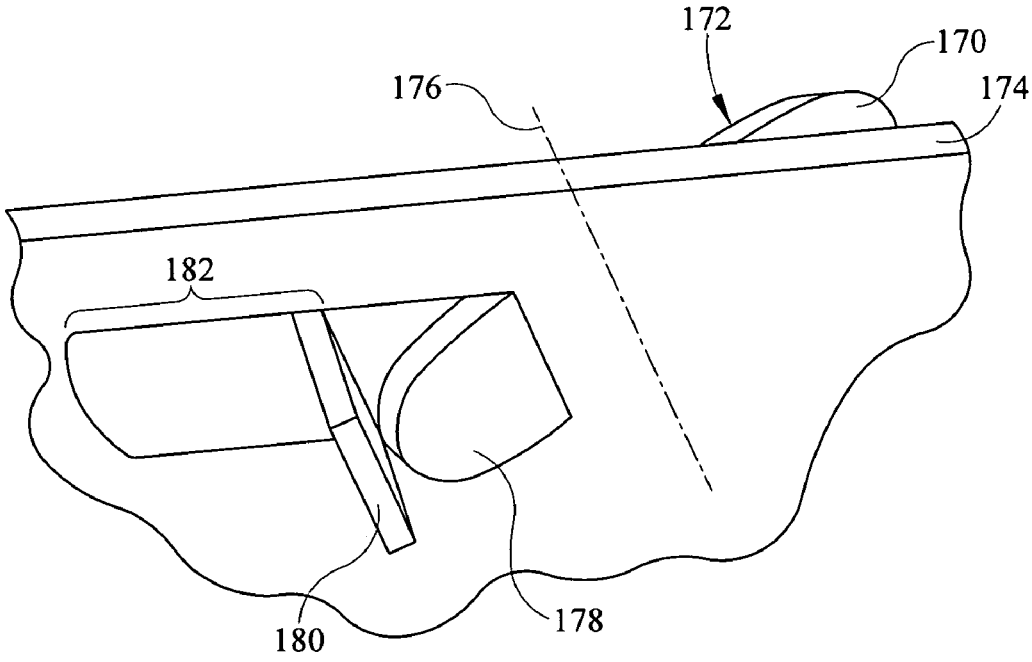
Figure 14:
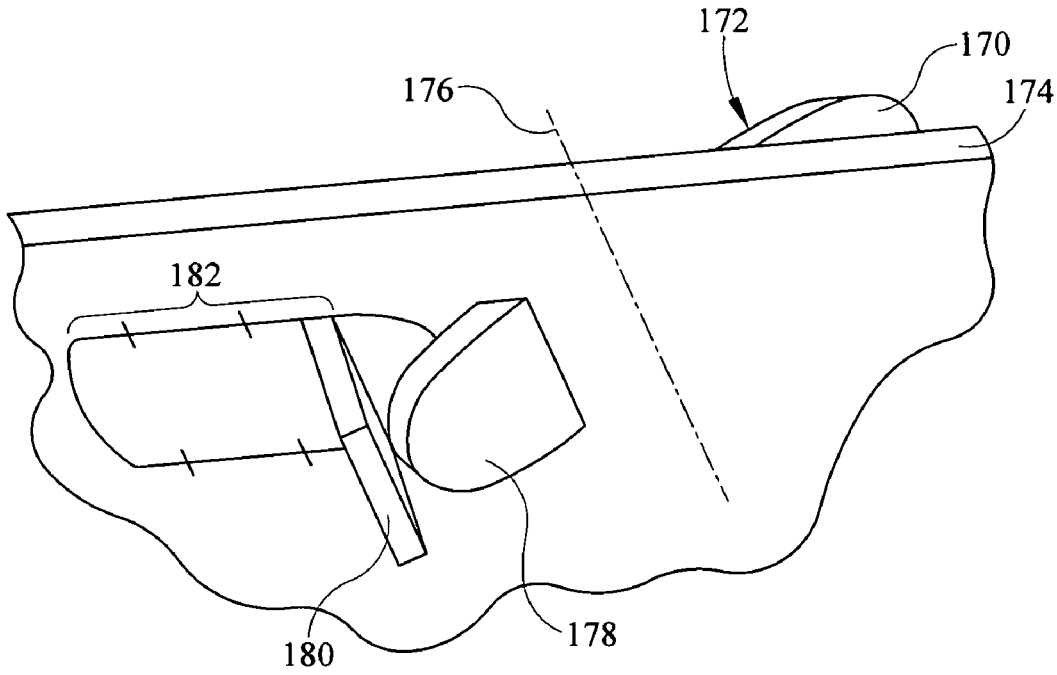

FIG. 11 illustrates variations in design of tab strips, tool portions, and how to vary line type usage to achieve various objectives. FIGS. 12-14 illustrate in greater detail the pivot action of the tool portions for embodiments of packing in which a tool portion is included, including the embodiments illustrated in FIGS. 1-6. As shown at the top of FIG. 12, as the grasping end 170 of a tool portion 172 is lifted away from the packaging 174, the tool portion 172 rotates about a pivot region 176. As explained above, a pivot region 176 can be formed by severing most of the tool portion, but leaving at least one edge hingedly connected to the surrounding material along one or more fold lines. As the tool portion 172 rotates about a pivot region 176, the actuating portion 178 of the tool portion 172 rotates downward, toward the packaging, and applies a force to a pull tab portion 180 of a tab strip 182. This force causes at least a portion of the pull tab portion 180 of the tab strip 182 to be pushed away from the packaging 174. A user can then grasp the pull tab portion 180 of a tab strip 182 and sever, at least partially, the tab strip 182 from the surrounding material of the packaging 174. FIGS. 13 and 14 illustrate this pivot action from another angle.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A packaging blank comprising:

a first panel comprising at least one blister aperture and at least one tool portion, wherein the at least one tool portion comprises a pull-away portion, an actuator portion, and a pair of spaced fold lines along which one of the pull-away portion and the actuator portion is connected to the first panel, the pull-away portion and the actuator portion being joined together through an area between the spaced fold lines, the pull-away portion and the actuator portion extend in opposite directions from the area to respective free ends thereof; and a second panel comprising at least one tab strip that is at least partially severable from the second panel, the at least one tab strip being provided at one of opposed ends thereof with a pull tab portion, the pull tab portion being disposed such that the free end of the actuator portion of the at least one tool portion is operably aligned with the pull tab portion of a corresponding one of the at least one tab strip when the first and second panels are positioned relative to one another in a face contacting arrangement to form a package.

2. The packaging blank of claim 1, wherein the at least one tool portion is configured such that a movement of the pull-away portion about the fold lines in a first rotational direction results in a movement of the actuator portion about the fold lines in a second rotational direction opposite to the first rotational direction.

3. The packaging blank of claim 1, wherein the second panel further comprises a gate portion that is created by removing the at least one tab strip from the second panel.

4. The packaging blank of claim 1, wherein the first panel and the second panel are configured to be secured together in the face contacting arrangement such that the pull-away portion of the at least one tool portion is offset from the corresponding one of the at least one tab strip.

5. A packaging blank comprising:

a first panel comprising at least one blister aperture and at least one tool portion, the at least one tool portion comprising an actuator portion and a joined pull-away portion, one of the actuator portion and the pull-away portion is connected to the first panel along at least one fold line, the pull-away portion extending in a first direction away from the at least one fold line to a free end thereof, the actuator portion extending away from the at least one fold line in a second direction opposite to the first direction; and a second panel comprising at least one tab strip that is at least partially severable from the packaging blank, wherein the at least one tab strip comprises a pull tab portion, wherein the actuator portion of the at least one tool portion is operably aligned with the pull tab portion of a corresponding one of the at least one tab strip when the first and second panels are secured together to form a package.

6. The packaging blank of claim 5, wherein the second panel further comprises a gate portion that is created by removing the at least one tab strip from the second panel.

7. The packaging blank of claim 1, wherein the free end of the pull-away portion provides a hand-graspable edge of the at least one tool portion.

8. The packaging blank of claim 1, wherein a cut line is made in the at least one tool portion such that material between the cut line and the free end of the pull-away portion is removed to create a graspable edge of the at least one tool portion.

9. The packaging blank of claim 1, wherein the fold lines are spaced apart by the other one of the pull-away portion and the actuator portion.

10. The packaging blank of claim 1, wherein the at least one tab strip is configured such that the at least one tab strip tapers from the pull tab portion toward the other end of the at least one tab strip.

11. The packaging blank of claim 5, wherein a cut line is made in the at least one tool portion such that material between the cut line and the free end of the pull-away portion is removed to create a graspable edge of the at least one tool portion.

12. The packaging blank of claim 5, wherein the at least one fold line comprises a pair of fold lines which are spaced apart from one another by the other one of the pull-away portion and the actuator portion.

13. The packaging blank of claim 5, wherein the pull-away portion of the at least one tool portion is offset from the corresponding one of the at least one tab strip.

14. A blister pack package comprising:

a blister pack comprising at least one blister;

a first panel comprising at least one blister aperture in which the at least one blister of the blister pack is received, and at least one tool portion provided next to the at least one blister aperture, wherein the at least one tool portion comprises a pull-away portion, an actuator portion, and a pair of spaced fold lines along which one of the pull-away portion and the actuator portion is connected to the first panel, the pull-away portion and the actuator portion being joined together through an area between the spaced fold lines, the pull-away portion and the actuator portion extend in opposite directions from the area to respective free ends thereof; and a second panel secured to the first panel in a face contacting arrangement with the blaster pack disposed between the first and second panels, the second panel comprising at least one tab strip disposed aligned with the at least one blister of the blister pack, the at least one tabs strip being at least partially severable from the second panel, the at least one tab strip being provided at one of opposed ends thereof with a pull tab portion, the pull tab portion being disposed such that the free end of the actuator portion of the at least one tool portion is operably aligned with the pull tab portion of a corresponding one of the at least one tab strip.

15. The blister pack package of claim 14, wherein the free end of the pull-away portion provides a hand-graspable edge of the at least one tool portion.

16. The blister pack package of claim 14, wherein a cut line is made in the at least one tool portion such that material between the cut line and the free end of the pull-away portion is removed to create a graspable edge of the at least one tool portion.

17. The blaster pack package of claim 14, wherein the fold lines are spaced apart by the other one of the pull-away portion and the actuator portion.

* * * * *